US009007166B2

(12) United States Patent
Tseng et al.

(10) Patent No.: US 9,007,166 B2
(45) Date of Patent: Apr. 14, 2015

(54) OVER-CURRENT PROTECTION DEVICE

(71) Applicant: Polytronics Technology Corp., Hsinchu (TW)

(72) Inventors: Chun Teng Tseng, Miaoli (TW); David Shau Chew Wang, Taipei (TW)

(73) Assignee: Polytronics Technology Corp., Hsinchu (TW)

( * ) Notice: Subject to any disclaimer, the term of this patent is extended or adjusted under 35 U.S.C. 154(b) by 220 days.

(21) Appl. No.: 13/737,802

(22) Filed: Jan. 9, 2013

(65) Prior Publication Data

US 2014/0049357 A1 Feb. 20, 2014

(30) Foreign Application Priority Data

Aug. 14, 2012 (TW) ..... 101129457 A

(51) Int. Cl.

| | |
|---|---|
| ***H01C 7/10*** | (2006.01) |
| ***H01C 7/13*** | (2006.01) |
| ***H01C 7/02*** | (2006.01) |
| ***H01C 1/14*** | (2006.01) |

(52) U.S. Cl.

CPC ..... *H01C 7/02* (2013.01); *H01C 1/1406* (2013.01); *H01C 7/13* (2013.01)

(58) Field of Classification Search

CPC ..... H01C 1/1406; H01C 7/02; H01C 7/021; H01C 7/13; H01C 7/18; H01C 13/02; H01C 17/00; H01C 17/006; H01C 17/28; H01C 1/028; H01C 17/02; H01C 17/06526; H01C 1/148; H01C 7/00; H01C 7/008

USPC ..... 338/22 R

See application file for complete search history.

(56) References Cited

U.S. PATENT DOCUMENTS

| | | | | |
|---|---|---|---|---|
| 6,794,980 | B2 * | 9/2004 | Chu et al. | 338/22 R |
| 7,102,483 | B2 * | 9/2006 | Hwang et al. | 338/22 R |
| 7,701,322 | B2 * | 4/2010 | Wang et al. | 338/22 R |
| 8,044,763 | B2 * | 10/2011 | Wang et al. | 338/22 R |
| 8,502,638 | B1 * | 8/2013 | Sha et al. | 338/22 R |
| 2003/0067729 | A1 * | 4/2003 | Chu et al. | 361/103 |
| 2013/0021704 | A1 * | 1/2013 | Tseng et al. | 361/93.8 |
| 2013/0187748 | A1 * | 7/2013 | Sha et al. | 338/22 R |

FOREIGN PATENT DOCUMENTS

| | | |
|---|---|---|
| TW | 539229 U | 6/2003 |
| TW | 556458 B | 10/2003 |

* cited by examiner

*Primary Examiner* — Kyung Lee
(74) *Attorney, Agent, or Firm* — Shimokaji IP

(57) ABSTRACT

An over-current protection device comprises a PTC material layer, a first electrode layer and a second electrode layer. The PTC material layer has opposite first and second surfaces and opposite first and second lateral surfaces. The first electrode layer is in physical contact with the first surface of the PTC material layer and extends to the first lateral surface. The second electrode layer is in physical contact with the first surface of the PTC material layer and extends to the second lateral surface. The second electrode layer is insulated from the first electrode layer by a first separation. The first electrode layer and the second electrode layer are substantially laterally symmetrical, and serve as interfaces for current flowing in and out of the device when the over-current protection device is in use.

23 Claims, 5 Drawing Sheets

OVER-CURRENT PROTECTION DEVICE

BACKGROUND OF THE INVENTION (1) Field of the Invention

The present application relates to a thermistor, and more particularly to an over-current protection device.

(2) Description of the Related Art

Over-current protection devices are used for protecting circuitries from damages resulted from over-heat or over-current. An over-current protection device usually contains two electrodes and a resistive material disposed therebetween. The resistive material has positive temperature coefficient (PTC) characteristic that the resistance thereof remains extremely low at room temperature and instantaneously increases to thousand times when the temperature reaches a critical temperature or the circuit has over-current, so as to suppress over-current and protect the cell or the circuit device. When the material gets back to the room temperature or over-current no longer exists, the over-current protection device returns to be of low resistance and as a consequence the circuitry can operate normally. In view of the reusable property, the PTC over-current protection devices can replace traditional fuses, and have been widely applied to high density circuits.

With lightweight and compact trends, electronic apparatuses are getting smaller. For a cell phone, a number of components have to be integrated into a limited space, in which an over-current protection device is usually secured to a protective circuit module (PCM) and its external lead will occupy a certain space. Therefore, it is desirable to have a thin-type protection device that does not take up much room. When the device is downsizing to form factor 0201, it is a great challenge on how to decrease the thickness of the protection device for surface-mount applications.

According to specification of 0201, a device has a length of 0.6±0.03 mm, a width of 0.3±0.03 mm and a thickness of 0.25±0.03 mm. In manufacturing, the length and width are doable, but the thickness is too thin to be achieved. Nowadays, the resistive material substrate of carbon black system can be at most pressed to 0.2 mm in thickness, and the resistive material substrate of ceramic filler system can obtain a thickness of 0.2-0.23 mm. If the resistive substrate is further engaged with insulating (prepreg) layers and internal and external circuits (electrodes) to form an over-current protection device as shown in U.S. Pat. No. 6,377,467, not only is the thickness out of specification but also the thickness may be equal to or larger than width. As a result, the devices may topple when they are subjected to packaging or other processes afterwards.

Moreover, the internal-and-external circuit design on a small size device sometimes has misalignment between the internal circuit and external circuit, and therefore the production yield will be negatively impacted.

U.S. Pat. No. 8,044,763 disclosed the use of low resistivity materials such as metal powders or metal carbides to make surface mountable devices (SMD), which is a breakthrough to the limitation of using carbon black as conductive fillers and significantly increase hold current per area to 0.16 $A/mm^2$, or even up to 1 $A/mm^2$. The hold current indicates the largest current of the device before trip. However, the mobile apparatuses had greatly advanced. It is demanded that the device be of smaller volume and more powerful, and thus more operating current is needed. Therefore, the upper limit of 1 $A/mm^2$ would be unsatisfactory, and larger hold current per effective PTC area is desired for a protection device with smaller area and larger operating current.

Therefore, it is a great challenge to make a small device with large hold current, and preferably the device structure can be simplified to decrease the process steps and manufacturing cost.

SUMMARY OF THE INVENTION

The present application relates to an over-current protection device of thin-type, which is able to meet the demands of compact over-current protection devices with large hold current per area.

In accordance with an embodiment of the present application, an over-current protection device comprises a PTC material layer, a first electrode layer and a second electrode layer. The PTC material layer has a first surface, a second surface, a first lateral surface and a second lateral surface. The first surface is opposite to the second surface, and the first lateral surface is opposite to the second lateral surface. The first electrode layer is in physical contact with the first surface of the PTC material layer and extends to the first lateral surface. The second electrode layer is in physical contact with the first surface of the PTC material layer and extends to the second lateral surface. The second electrode layer is insulated from the first electrode layer by a first separation. The first electrode layer and the second electrode layer are substantially laterally symmetrical, and serve as interfaces for current flowing in and out of the over-current protection device when the device is in use.

In an embodiment, the over-current protection device further comprises a third electrode layer disposed on the second surface of the PTC material layer. The third electrode layer overlaps the first electrode layer and the second electrode layer in vertical, thereby forming an over-current protection device of an equivalent circuit including two PTC thermistors connected in series.

According to the present application, it is advantageous that the over-current protection devices can be made from the PTC substrate directly. That is, the devices need not include prepreg layers and external electrodes. As such, it merely needs to make separation such as a gap by, for example, etching an electrode layer of the PTC substrate to form the first electrode layer and the second electrode layer.

In an embodiment, the electrode layers comprise copper layers on which a portion is electroplated with tin and another portion without tin-electroplating is covered with solder mask. The tin-electroplated portion is used as an interface for reflow soldering. In addition to the thickness of the PTC material layer, the increase of thickness of the device is only attributed to copper electroplating, tin electroplating and solder masking. Therefore, the over-current protection device of thin-type can be obtained.

Because the over-current protection device needs not be subjected to pressing process and has no external circuit, misalignment between internal circuit and external circuit no longer exists, thereby increasing production yield.

In an embodiment, the value of the hold current of the over-current protection device divided by the PTC material area can be greater than 1 $A/mm^2$ and up to 6.5 $A/mm^2$, so as to meet the requirement of large current applications.

BRIEF DESCRIPTION OF THE DRAWINGS

The present application will be described according to the appended drawings in which.

DETAILED DESCRIPTION OF THE INVENTION

The making and using of the presently preferred illustrative embodiments are discussed in detail below. It should be appreciated, however, that the present application provides many applicable inventive concepts that can be embodied in a wide variety of specific contexts. The specific illustrative embodiments discussed are merely illustrative of specific ways to make and use the invention, and do not limit the scope of the invention.

Figure 1:
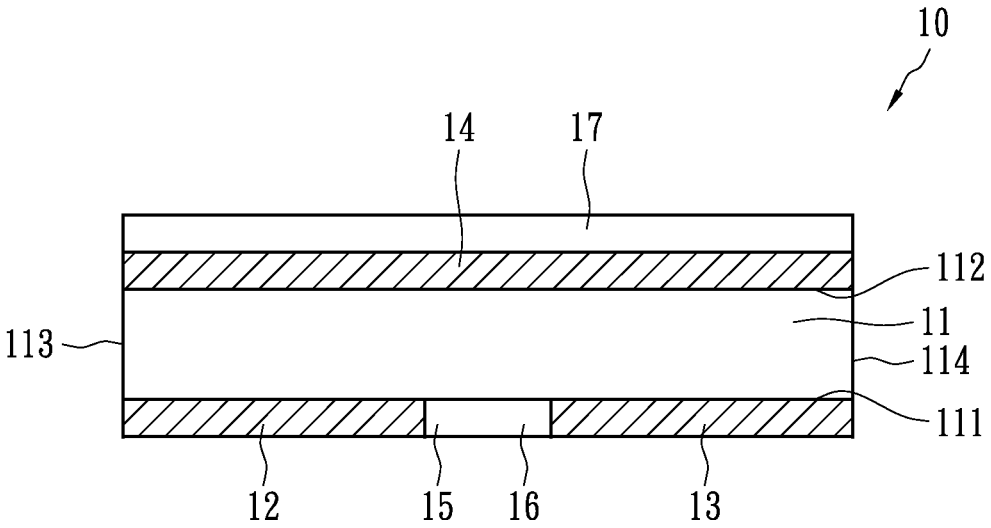
FIG. 1 shows an over-current protection device in accordance with a first embodiment of the present application.

FIG. 1 shows a side view of an over-current protection device in accordance with the first embodiment of the present application. The over-current protection device 10 comprises a PTC material layer 11 having a first planar surface 111, a second planar surface 112, a first lateral surface 113 and a second lateral surface 114. The second planar surface 112 is opposite to the first planar surface 111, and the first lateral surface 113 is opposite to the second lateral surface 114. A first electrode layer 12 is in physical contact with the first planar surface 111 of the PTC material layer 11 and extends to the first lateral surface 113. The second electrode layer 13 is in physical contact with the first planar surface 111 of the PTC material layer 11 and extends to the second lateral surface 114. The second electrode layer 13 is insulated from the first electrode layer 12 by a first separation 15, e.g., a gap. A third electrode layer 14 is in physical contact with the second planar surface 112 and extends from the first lateral surface 113 to the second lateral surface 114. In an embodiment, the separation 15 is filled with solder mask 16 and the third electrode layer 14 is also covered by solder mask 17 to avoid short circuit events. The first electrode layer 12 and the second electrode layer 13 have approximately equivalent lengths, and they are substantially laterally symmetrical in relation to the first separation 15. When the over-current protection device 10 is in use, the first electrode layer 12 and the second electrode layer 13 serve as interfaces for current flowing in and out of the over-current protection device 10, respectively. The first electrode layer 12 and the second electrode layer 13 can be secured to the surface of a protective circuit module by reflow soldering.

The PTC material layer 11 contains crystalline polymer and conductive filler with resistivity less than 500 μΩ-cm. The resistivity of the PTC material layer is less than 0.2 Ω-cm. The crystalline polymer may comprise polyethylene, polypropylene, polyvinylfluoride, the mixture or the copolymer thereof. The conductive filler may comprise metal filler, metal carbide, metal boride, metal nitride or the mixture thereof. For example, the metal filler may be nickel, cobalt, copper, iron, tin, lead, silver, gold, platinum, or the alloy thereof. The ceramic filler may be titanium carbide, titanium carbide (TiC), tungsten carbide (WC), vanadium carbide (VC), zirconium carbide (ZrC), niobium carbide (NbC), tantalum carbide (TaC), molybdenum carbide (MoC), hafnium carbide (HfC), titanium boride ($TiB_2$), vanadium boride ($VB_2$), zirconium boride ($ZrB_2$), niobium boride ($NbB_2$), molybdenum boride ($MoB_2$), hafnium boride ($HfB_2$), or zirconium nitride (ZrN). Moreover, the conductive filler may be the mixture, alloy, solid solution or core-shell of the aforesaid metal and ceramic fillers.

The compositions of four examples are shown in Table 1. The conductive filler that may be metal or ceramic comprises 70%-96%, or preferably 75%-95% by weight of the PTC material layer 11. The conductive filler may comprise 85%-95% by weight of the PTC material layer 11 if tungsten carbide is selected.

TABLE 1

| | HDPE1 (g) | HDPE2 (g) | Ni (g) | WC (g) | TiC (g) | Resistivity (Ω-cm) |
|---|---|---|---|---|---|---|
| Example 1 | 17.8 | 3.2 | — | — | 130 | 0.00492 |
| Example 2 | 20.8 | — | — | 284 | — | 0.00791 |
| Example 3 | 21 | — | 27.2 | — | 115 | 0.00653 |
| Example 4 | 21.2 | — | 18 | 255 | — | 0.00719 |

HDPE1 employs TAISOX HDPE/9001 high density polyethylene, a product of Formosa Plastics Corporation, with a density of 0.951 g/cm$^3$ and a melting point of 130° C. HDPE2 employs TAISOX HDPE/8010 high density polyethylene with a density of 0.956 g/cm$^3$ and a melting point of 134° C. The nickel powder employs Atlantic Equipment Engineering (AEE) NI-102 with a form of flake, a particle size of 3 μm, and a resistivity ranging from 6 μΩ-cm to 15 μΩ-cm. The tungsten carbide employs AEE WP-301 with a resistivity around 80 μΩ-cm and a particle size of 1-5 μm. The titanium carbide employs AEE TI-301 with a resistivity ranging from 180 μΩ-cm to 250 μΩ-cm and a particle size of 1-5 μm. In practice, the size of the conductive filler is between 0.01 μm and 30 μm, and preferably between 0.1 μm and 10 μm. The aspect ratio of conductive filler is less than 500, or preferably less than 300.

The first electrode layer 12 and the second electrode layer 13 can be made from a planar metal plate in which a gap 15 is formed by laser trimming, chemical etching or mechanical machining. The first electrode layer 12 and the second electrode layer 13 can be made of nickel, copper, zinc, silver, gold, the alloy thereof or a multilayer containing the above materials. In addition, the gap 15 may be of rectangular, semi-circular, triangular or irregular shape or figure.

Normally, current flows through a path of less resistance. Therefore, the current will flow through the path including the first electrode layer 12, the PTC material layer 11, the third electrode layer 14, the PTC material layer 11 and the second electrode layer 13 in order. From circuit perspective, the equivalent circuit of the over-current protection device 10 comprises two PTC thermistors connected in series.

Figure 2:
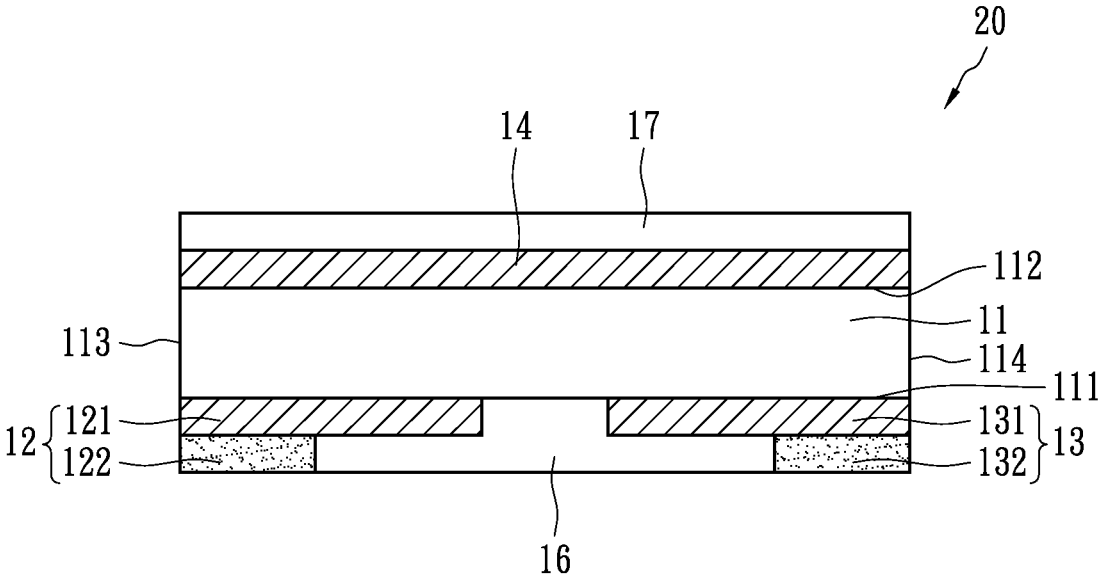
FIG. 2 shows an over-current protection device in accordance with a second embodiment of the present application.

FIG. 2 shows a side view of an over-current protection device 20 in accordance with the second embodiment of the present application. Unlike the structure shown in FIG. 1, the first electrode layer 12 is specified to a composite structure containing a copper layer 121 and a tin layer 122, and the second electrode layer 13 is a composite structure containing a copper layer 131 and a tin layer 132. As a result, the over-current protection device 20 is easily subjected to reflow-soldering for being surface-mounted on a circuit board. In an embodiment, the copper layer 121 has a longer length than that of the tin layer 122, and the copper layer 131 is longer than the tin layer 132 also. In practice, the copper layer and the tin layer can be of same length. From circuit perspective, the equivalent circuit of the over-current protection device 20 contains two PTC thermistors connected in series.

Figure 3:
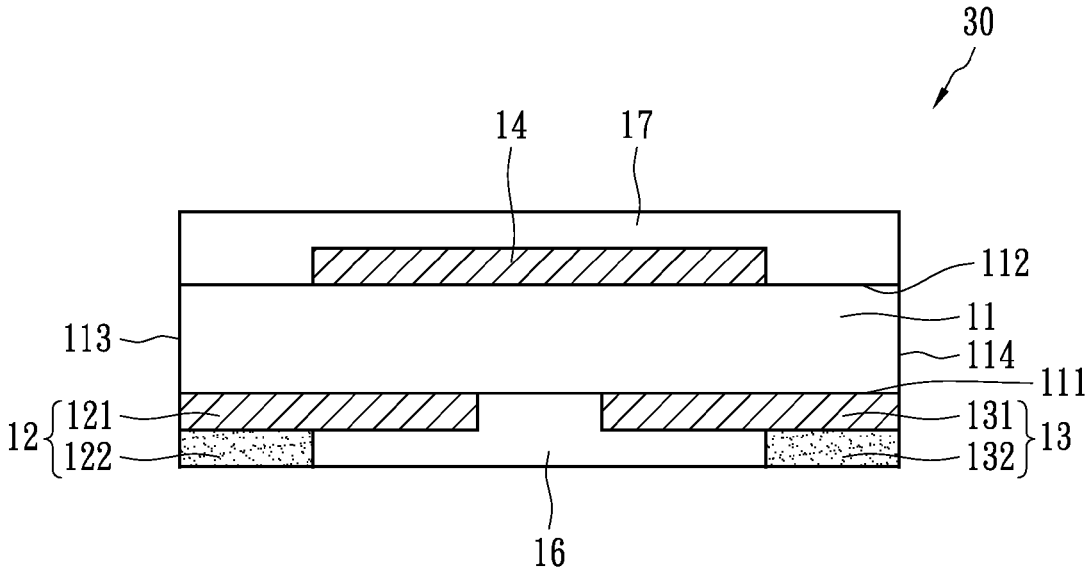
FIG. 3 shows an over-current protection device in accordance with a third embodiment of the present application.

FIG. 3 shows a side view of an over-current protection device 30 in accordance with the third embodiment of the present application. Unlike the structure shown in FIG. 2, the third electrode layer 14 does not extend from the first lateral surface 113 to the second lateral surface 114, and the remaining portions are covered by the solder mask 17. It should be noted that the third electrode layer 14 cannot be too short to constitute electrically conductive paths. The third electrode layer 14 has to partially overlap the first electrode layer 12 and the second electrode layer 13 in vertical, so as to constitute conductive paths. The ratio of the overlap area to the area of the third electrode layer is between 50% and 90%. From circuit perspective, the equivalent circuit of the over-current protection device 30 comprises two PTC thermistors connected in series.

Figure 4:
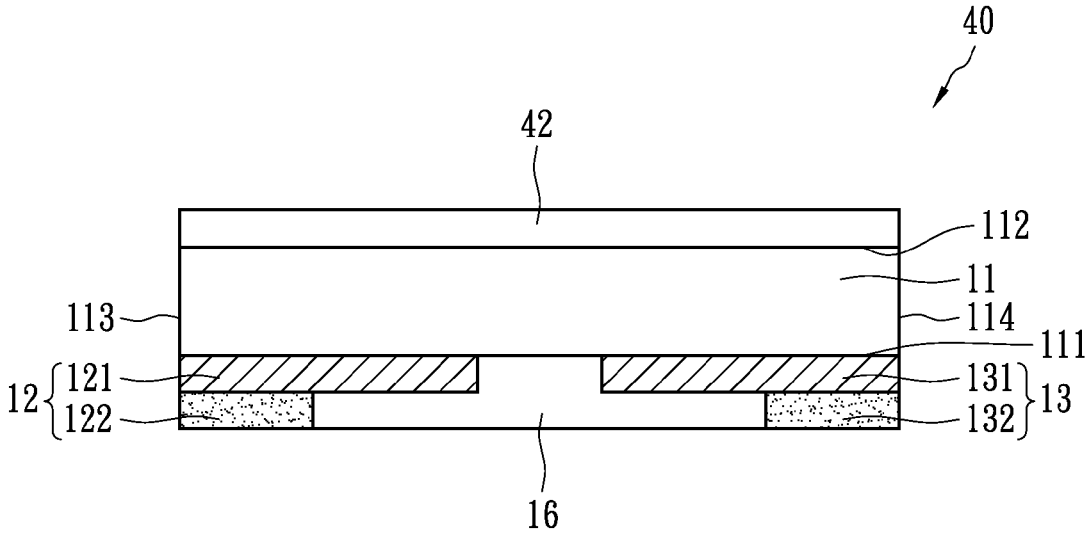
FIG. 4 shows an over-current protection device in accordance with a fourth embodiment of the present application.

FIG. 4 shows a side view of the over-current protection device 40 in accordance with the fourth embodiment of the present application. Unlike the structure shown in FIG. 2, the third electrode layer 14 is omitted and an insulating layer 42 is directly formed on the second surface 112. The insulating layer 42 may be a solder mask. Alternatively, the insulating layer 42 may be fiber glass material such as prepreg, so as to increase the structural strength of the device and avoid deformation during manufacturing. In this embodiment, current flows from the first electrode layer 12 to the second electrode layer 13 through the PTC material layer 11. From circuit perspective, the equivalent circuit of the over-current protection device 40 comprises a PTC thermistor.

Figure 5:
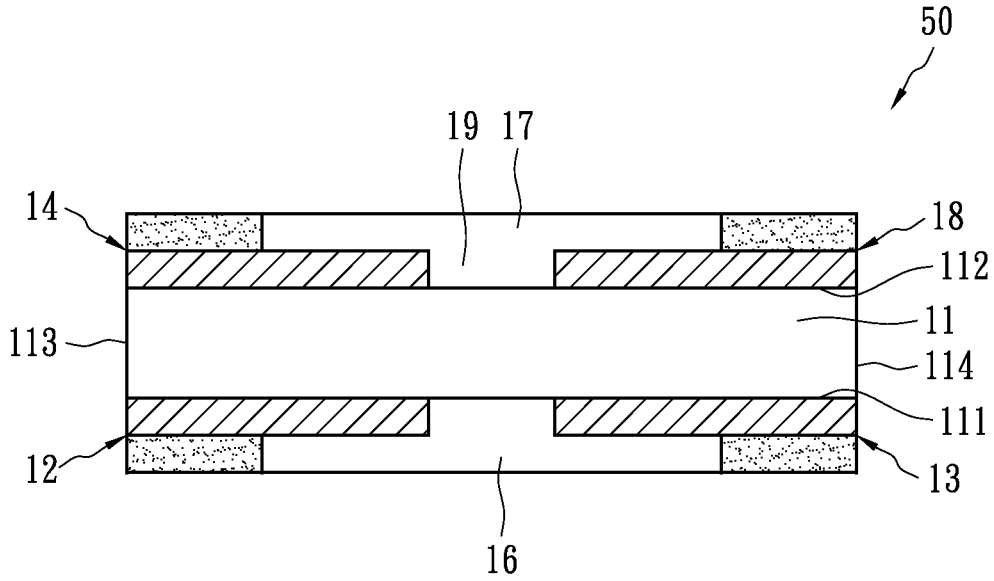
FIG. 5 shows an over-current protection device in accordance with a fifth embodiment of the present application.

FIG. 5 shows a side view of the over-current protection device 50 in accordance with a fifth embodiment of the present application. Unlike the structure shown in FIG. 4, the device 50 further comprises a third electrode layer 14 and a fourth electrode layer 15. The third electrode layer 14 is in physical contact with the second surface 112 and extends to the first lateral surface 113. The fourth electrode layer 18 is in physical contact with the second surface 112 and extends to the second lateral surface 114. The fourth electrode layer 18 is insulated from the third electrode layer 14 by a second separation 19. In an embodiment, the separation 19 is filled with the solder mask 17. In an embodiment, the solder mask 17 can be replaced with an insulating layer containing fiber glass. Because the third electrode layer 14 and the fourth electrode layer 18 are electrically isolated and the third electrode layer 14 is not coupled to a power source, current will flow from the first electrode layer 12 to the second electrode layer 13 rather than the third electrode layer 14. The current path of this embodiment is similar to that shown in the fourth embodiment. Because the over-current protection device is a symmetrical structure, it needs not consider the directionality when surface-mounting to a circuit board. From circuit perspective, the equivalent circuit of the over-current protection device 50 comprises a PTC thermistor.

Figure 6:
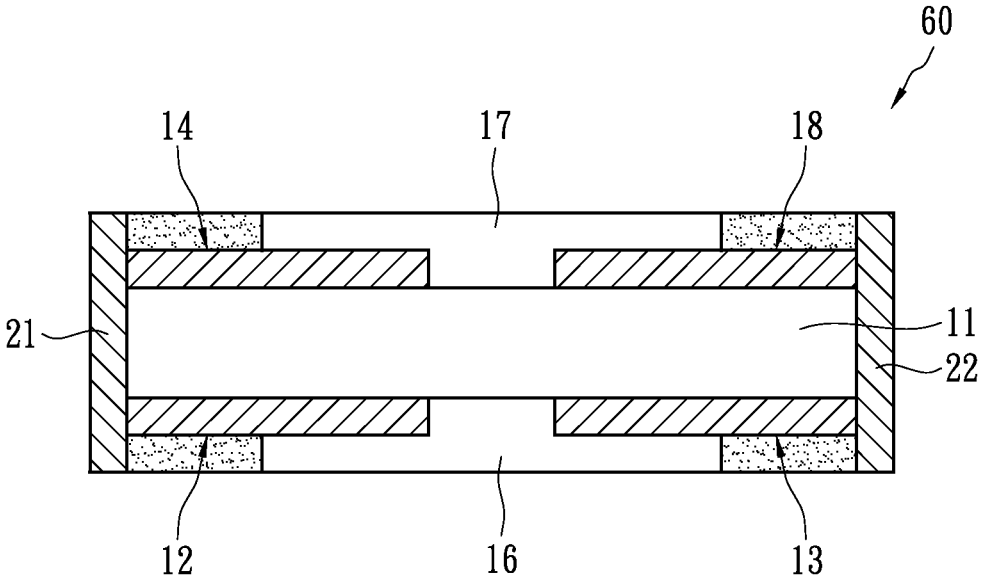
FIG. 6 shows an over-current protection device in accordance with a sixth embodiment of the present application.

FIG. 6 shows a side view of an over-current protection device 60 in accordance with a sixth embodiment of the present application. Compared to the structure shown in FIG. 5, the over-current protection device 60 further comprises a first conductive member 21 and a second conductive member 22. The first electrode layer 12 and the third electrode layer 14 are electrically connected through the first conductive member 21, whereas the second electrode layer 13 and the fourth electrode layer 18 are electrically connected through the second conductive member 22. In an embodiment, the solder mask 17 can be replaced with an insulating layer containing fiber glass. Compared to the device 50 shown in FIG. 5, the current in device 60 goes through the paths from the electrodes 12 and 14 to the electrodes 13 and 18, thereby allowing a large amount of current to flow therethrough. The first conductive member 21 and the second conductive member 22 can be circular conductive holes, semicircular conductive holes, quadrantal conductive holes, conductive side walls or the like which are known by the people having ordinary skill in the art.

According to the present application, the over-current protection device can be manufactured from a PTC substrate directly, and the prepreg or external electrode layers are not needed. A separation can be easily made in an electrode on a side by etching to form a left electrode (e.g., the first electrode 12) and a right electrode (e.g., the second electrode 13). According to the thin-type design, the thickness of the over-current protection device can be equal to or less than 0.28 mm, or less than 0.26 mm, 0.24 mm, 0.22 mm or 0.20 mm in particular. Thus it complies with the requirements of the form factor 0201. According to the present application, the over-current protection device can effectively decrease its thickness and therefore it is suitable for being used in a variety of compact electronic apparatuses. It should be noted that the thin-type design is not limited to 0201 device. Given the simplified structure, the over-current protection device can be applied to 1210, 1206, 0805, 0603, and 0402 as well.

The above embodiments relate to SMD applications. Moreover, the over-current protection device can be further associated with external leads to form axial-type or radial-type over-current protection devices.

Figure 7:
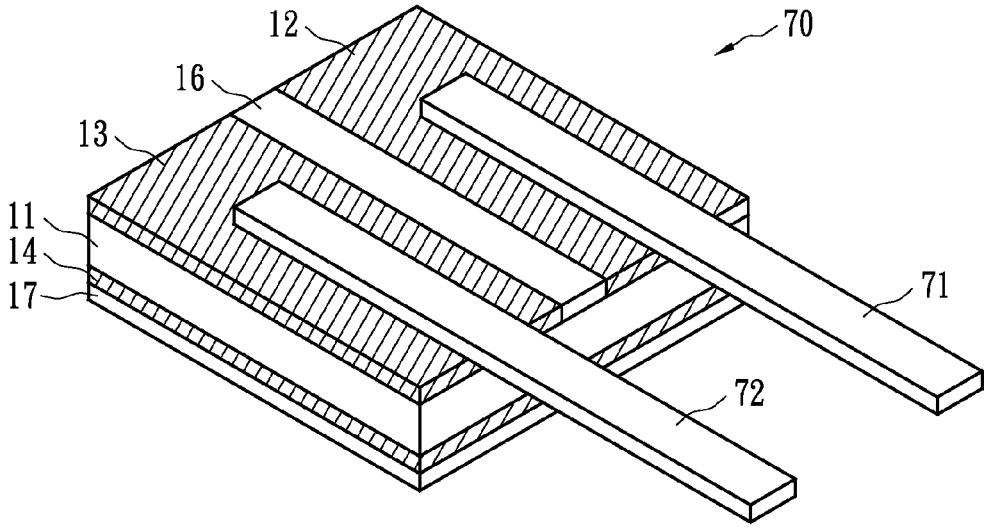
FIG. 7 shows an over-current protection device in accordance with a seventh embodiment of the present application.

FIG. 7 shows an over-current protection device 70 in accordance with the seventh embodiment of the present application. The over-current protection device 70 is like an over-turned device 10 of FIG. 1 jointed with two external leads 71 and 72. More specifically, the external lead 71 is connected to the first electrode layer 12, and the external lead 72 is connected to the second electrode layer 13. The external lead 71 and the external lead 72 are in parallel and go in the same direction, so as to form a radial-type over-current protection device 70.

Figure 8:
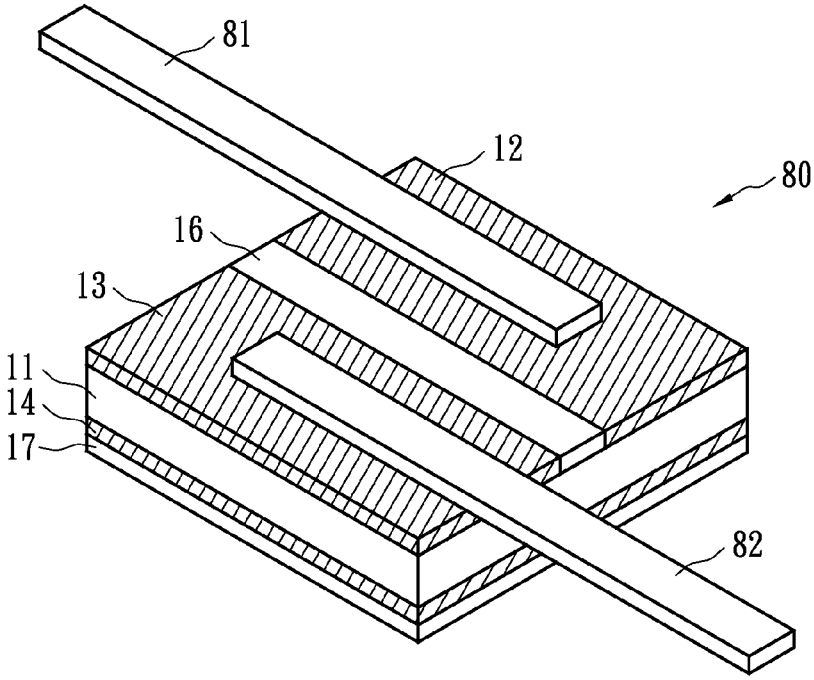
FIG. 8 shows an over-current protection device in accordance with a eighth embodiment of the present application.

FIG. 8 shows an over-current protection device 80 in accordance with the eighth embodiment of the present application. The over-current protection device 80 is like the structure shown in FIG. 7 except two external leads extending in different directions. More specifically, the external lead 81 is connected to the first electrode layer 12, and the external lead 82 is connected to the second electrode layer 13. The external lead 81 and the external lead 82 are in parallel and go in opposite directions, so as to form the radial-type over-current protection device 80.

Figure 9:
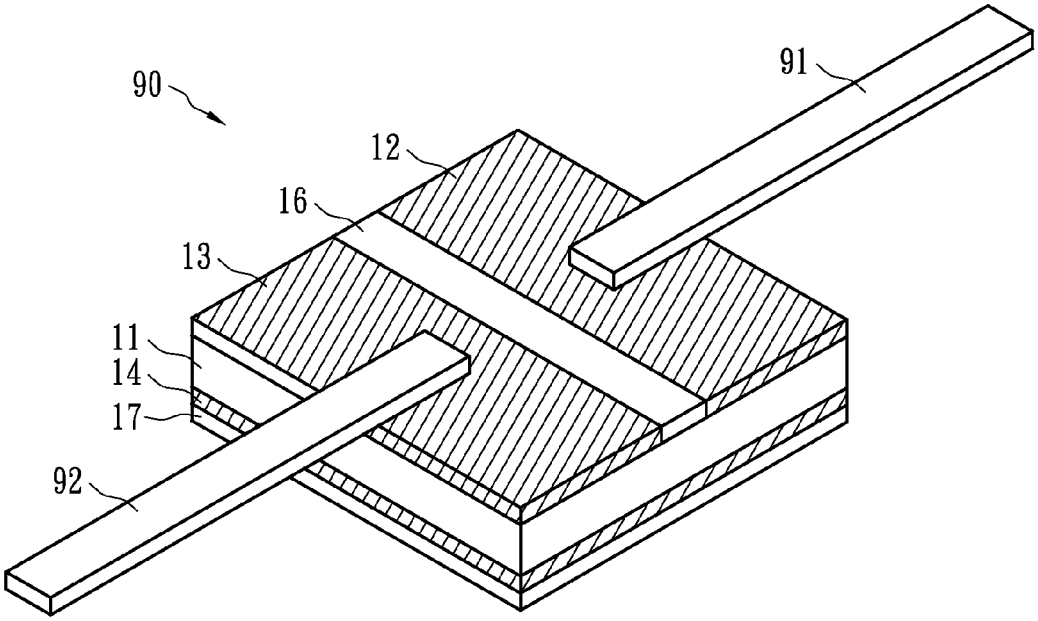
FIG. 9 shows an over-current protection device in accordance with a ninth embodiment of the present application.

FIG. 9 shows an over-current protection device 90 in accordance with the ninth embodiment of the present application. The over-current protection device 90 is like the structure shown in FIG. 8 except two external leads extending in different directions. More specifically, the external lead 91 is connected to the first electrode layer 12, and the external lead 92 is connected to the second electrode layer 13. The external lead 91 and the external lead 92 go in opposite directions along an axis, so as to form the axial-type over-current protection device 90.

The aforesaid embodiments jointing with external leads are not limited to implementation in the over-current protection device 10, the device 20, 30, 40, 50 or 60 can be jointed with external leads in similar ways, so as to provide various applications.

The current flowing through the PTC material of SMD devices will generate heat due to the resistance thereof, the amount of heat is proportional to the area of the PTC material layer $A_{PTC}$. The heat is transferred from the PTC material layer to outside, i.e., the heat is transferred to the surface of the device through electrodes, and electrical conductors if any, and then the heat is dissipated to ambient environment. Accordingly, the heat dissipation relates to the total area of the electrodes and conductors. The ratio of the heat dissipation of the electrodes and conductors to the heat generation of the PTC material layer can be defined as heat dissipation factor F.

F=(A1+A2)/A3, where A1 is the total area of the electrodes, A2 is the total area of the conductors, and A3 is the total area of the PTC material layer. A3 is usually equal to $A_{PTC}$×the number of the PTC material layers.

The optional conductors, such as the conductive members 21 and 22 in FIG. 6, are configured to connect the electrode layers, and play the roles for both heat transfer and electrical conduction. The conductor has to be capable of efficiently dissipating the heat generated from the PTC material layer. The heat dissipation capability is proportional to the area of the conductor.

Referring to FIG. 1 to FIG. 3, A1 is equal to the sum of the areas of the electrode layers 12, 13 and 14 (the areas in top or bottom view), and the A3 is equal to $A_{PTC}$. A2 is zero because there is no conductor. As to FIG. 4, A1 is equal to the total area of the electrode layers 12 and 13 (the areas in bottom view), A3 is equal to $A_{PTC}$, and A2 is zero. As to FIG. 5, A1 is equal to the total area of the electrodes 12, 13, 14 and 18 (the areas in top or bottom view), A3 is equal to $A_{PTC}$, and A2 is zero. Compared to FIG. 5, the over-current protection device 60 in FIG. 6 further comprises conductive members 21 and 22 to connect the electrode layers 12 and 14, and electrode layers 13 and 18, respectively. Therefore, A2 is equal to the total area of the conductive members 21 and 22.

The conductor may be of various shapes, and its area can be calculated as follows.

For a conductor of cylinder shape such as a circular through hole, A2=π×the diameter of the cylinder×the length of the cylinder (or the thickness of the device).

For a conductor in partial cylinder shape such as a semi-circular or quadrant through hole, A2=the arc of the partial cylinder×the length of the partial cylinder (or the thickness of the device).

For a conductor on a full sidewall surface, A2=the width of the device×the thickness of the device.

As to the electrode layers 12 and 13 of composite structure in FIGS. 2 to 6, A1 is equal to the area of copper layers 121 and 131.

The value R of hold current per PTC material area can be calculated as follows. R=hold current/$A_{PTC}$. For example, $A_{PTC}$ of a 0201 device is approximately equal to 0.02 inch×0.01 inch=0.508 mm×0.254 mm=0.129 $mm^2$.

The R values for devices of various form factors are recorded as Table 2. The compositions of the PTC material layer refer to Table 1, and the structures of the device refer to FIG. 2. Given larger heat dissipation factor indicates better heat dissipation efficiency, it can be seen from Table 2 that the one with larger heat dissipation factor has larger R value. The devices shown in FIGS. 1 to 3 comprise the first and second electrode layers 12 and 13, and another electrode layer 14 on the opposite side. The heat dissipation factors are between around 1 and 2. The device shown in FIG. 4 comprise the electrode layers 12 and 13 only on a single side, the heat dissipation factor is between around 0.6 and 0.9. As to the embodiment shown in FIG. 6, the device comprises the electrode layers 12, 13, 14 and 18 on both sides and the conductive members 21 and 22, and therefore has larger heat dissipation factor which can be up to 2.3 in practice. In view of the above, the heat dissipation factor has to be greater than 0.6 in obtaining good heat dissipation performance. It is advantageous that the heat dissipation factor is between 0.6 and 2.3, or between 1 and 2 in particular. The influence of the heat dissipation factor to the hold current becomes much apparent for the device of a form factor equal to or smaller than 0603 or 0402.

TABLE 2

| Example | Form factor | Heat dissipation factor F. | Hold current (A) | Area of PTC material layer ($mm^2$) | R ($A/mm^2$) |
|---|---|---|---|---|---|
| 1 | 0603 | 1.55 | 2.2 | 1.161 | 1.89 |
| 2 | 0402 | 1.72 | 1.2 | 0.516 | 2.32 |
| 3 | 0402 | 1.72 | 1.5 | 0.516 | 2.91 |
| 4 | 0201 | 1.85 | 0.5 | 0.129 | 3.87 |

Figure 10:
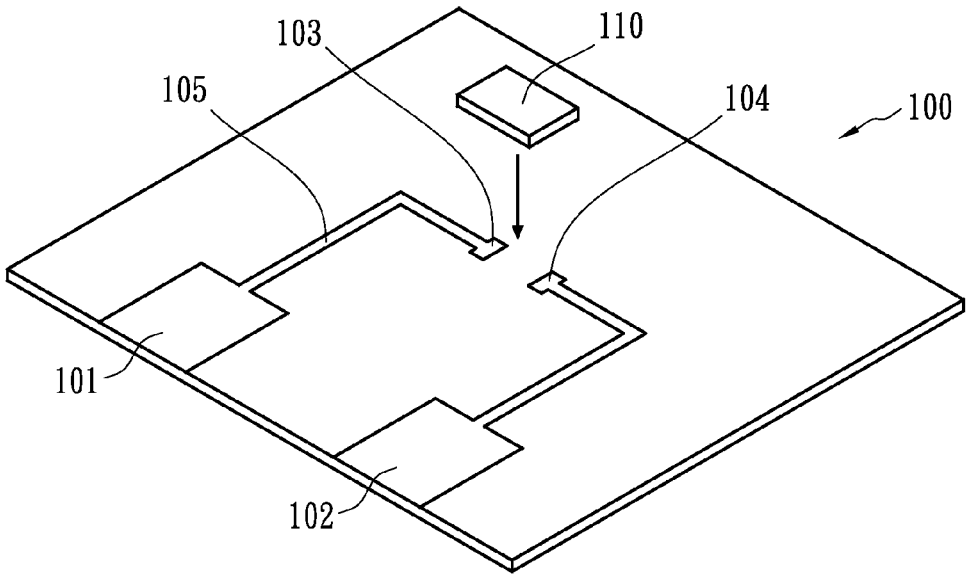
FIG. 10 shows hold current testing for the over-current protection device of the present application.

The over-current protection device is usually secured to a test board as shown in FIG. 10. The test board 100 has circuit layout of conductive areas 101 and 102, which are connected to electric contacts 103 and 104 through test conductive line 105, respectively. For hold current testing, the device is placed on the test board 100 in which the first electrode layer 12 and the second electrode layer 13 are connected or soldered to the electric contacts 103 and 104, respectively. The conductive areas 101 and 102 are configured to be connected to test wires that provide testing currents. The width of the test conductive line 105 is around 10-30 mil. The data in Table 2 is obtained on the basis of the use of a test board having the test conductive line 105 of 10-30 mil.

Table 3 shows the test results of 0201 device of the present application under different conductive line widths.

TABLE 3

| Test conductive line width | Form factor | Heat dissipation Factor F. | Hold current | PTC area ($mm^2$) | R ($A/mm^2$) |
|---|---|---|---|---|---|
| 10 mil | 0201 | 2.24 | 0.25 | 0.129 | 1.94 |
| 20 mil | 0201 | 2.24 | 0.36 | 0.129 | 2.79 |
| 30 mil | 0201 | 2.24 | 0.48 | 0.129 | 3.72 |
| 100 mil | 0201 | 2.24 | 0.77 | 0.129 | 5.96 |

It is observed from Table 3 that the wider the test conductive line, the larger the hold current and R value are. When 0201 devices are tested on the boards with test conductive lines of 10 mil (0.254 mm) to 100 mil (2.54 mm), the hold current per PTC area can be up to 6 $A/mm^2$. In practice, the hold current per PTC area is approximately between 1 and 6.5 $A/mm^2$, or preferably between 1.5 and 6 $A/mm^2$.

The device of the present application is of a simplified structure, and therefore needs not undergo complex process such as pressing. Moreover, there is no external circuit, so the misalignment event between internal and external electrodes no longer exists and therefore production yield can be increased. When the present application is applied to the compact devices, the hold current per PTC area can be increased and meet the requirements of large current applications.

The above-described embodiments of the present invention are intended to be illustrative only. Numerous alternative embodiments may be devised by persons skilled in the art without departing from the scope of the following claims.

What is claimed is:

1. An over-current protection device, comprising:

a PTC material layer having a first surface, a second surface, a first lateral surface and a second lateral surface, the second surface being opposite to the first surface, and the second lateral surface being opposite to the first lateral surface;

a first electrode layer in physical contact with the first surface of the PTC material layer and extending to the first lateral surface;

a second electrode layer in physical contact with the first surface of the PTC material layer and extending to the second lateral surface, the second electrode layer being insulated from the first electrode layer by a first separation; and a third electrode layer being a continuous single member in direct contact with the second surface of the PTC material layer and extending across the first separation;

wherein the first, second and third electrode layers and the PTC material layer extend parallel with one another to form a laminate structure, and the third electrode layer has a portion overlapping the first and second electrode layers to form a circuit containing two PTC thermistors in serial connection;

wherein the first electrode layer and the second electrode layer are substantially bilaterally symmetrical to each other, and serve as interfaces for current flowing in and out of the over-current protection device, respectively;

wherein current flows in and out of the over-current protection device through a path of the first electrode layer, the PTC material layer, the third electrode layer, the PTC material layer and the second electrode layer in order when the over-current protection device is in use.

2. The over-current protection device of claim 1, wherein the first separation comprises solder mask.

3. The over-current protection device of claim 1, wherein a value of a total area of the first and second electrode layers divided by an area of the PTC material layer is between 0.6 and 0.9.

4. The over-current protection device of claim 1, wherein the third electrode layer extends from the first lateral surface to the second lateral surface.

5. The over-current protection device of claim 1, further comprising a solder mask formed on the third electrode layer.

6. The over-current protection device of claim 1, wherein a value of a total area of the first, second and third electrode layers divided by an area of the PTC material layer is between 1 and 2.

7. The over-current protection device of claim 1, wherein the over-current protection device has a thickness equal to or less than 0.28 mm.

8. The over-current protection device of claim 1, wherein the over-current protection device is of surface mountable type.

9. The over-current protection device of claim 1, wherein the over-current protection device is of form factor equal to or smaller than 1210.

10. The over-current protection device of claim 1, wherein a value of hold current of the over-current protection device divided by an area of the PTC material layer is in the range of 1 $A/mm^2$ to 6.5 $A/mm^2$.

11. The over-current protection device of claim 10, wherein the hold current is tested by a board of which a test conductive line has a width between 10 and 100 mil.

12. The over-current protection device of claim 1, further comprising:

a first external lead connected to the first electrode layer; and a second external lead connected to the second electrode layer.

13. The over-current protection device of claim 12, wherein the first external lead and the second external lead are in parallel and extend in a same direction.

14. The over-current protection device of claim 12, wherein the first external lead and the second external lead extend in opposite directions.

15. The over-current protection device of claim 14, wherein the first external lead and the second external lead are in parallel or along a same axis.

16. The over-current protection device of claim 1, wherein the portion of overlapping comprises 50%-90% of an area of the third electrode layer.

17. An over-current protection device, comprising:

a PTC material layer having a first surface, a second surface, a first lateral surface and a second lateral surface, the second surface being opposite to the first surface, and the second lateral surface being opposite to the first lateral surface;

a first electrode layer in physical contact with the first surface of the PTC material layer and extending to the first lateral surface; and a second electrode layer in physical contact with the first surface of the PTC material layer and extending to the second lateral surface, the second electrode layer being insulated from the first electrode layer by a first separation;

wherein the first and second electrode layers and the PTC material layer extend parallel with respect to one another to form a laminate structure with an equivalent circuit of a single PTC thermistor, current flows through the first electrode layer, the PTC material layer and the second electrode layer in order and flows through the PTC material layer in a direction parallel to the PTC material layer;

wherein the first electrode layer and the second electrode layer are substantially bilaterally symmetrical to each other, and serve as interfaces for current flowing in and out of the over-current protection device, respectively.

18. The over-current protection device of claim 17, further comprising:

a third electrode layer in physical contact with the second surface and extending to the first lateral surface; and a fourth electrode layer in physical contact with the second surface and extending to the second lateral surface, the fourth electrode layer being insulated from the third electrode layer by a second separation.

19. The over-current protection device of claim 18, wherein the third and fourth electrode layers are substantially bilaterally symmetrical to each other.

20. The over-current protection device of claim 18, wherein the first electrode layer and the third electrode layer are electrically connected through a first conductive member, and the second electrode layer and the fourth electrode layer are electrically connected through a second conductive member.

21. The over-current protection device of claim 20, wherein a value of a total area of the first, second, third and fourth electrode layers and the first and second conductive members divided by an area of the PTC material layer is between 0.6 and 2.3.

22. The over-current protection device of claim 17, wherein the over-current protection device has a thickness equal to or less than 0.28 mm.

23. The over-current protection device of claim 17, wherein a value of hold current of the over-current protection device divided by an area of the PTC material layer is in the range of 1 $A/mm^2$ to 6.5 $A/mm^2$.

* * * * *